United States Patent [19]

Frolov et al.

[11] 4,226,406

[45] Oct. 7, 1980

[54] APPARATUS FOR THE COMPLEX CONTINUOUS PROCESSING OF POLYMETALLIC RAW MATERIALS

[76] Inventors: Jury F. Frolov, ulitsa Muranovskaya, 11, kv. 29, Moscow; Jury F. Piljukov, ulitsa Nemirovicha-Danchenko, 163, kv. 6, Novosibirsk; Vladimir S. Cherednichenko, ulitsa Zorge, 269, kv. 79, Novosibirsk; Gennady I. Orlov, ulitsa Vatutina, 27, kv. 20, Novosibirsk; Igor N. Kurapin, prospekt K. Marxa, 3, kv. 52, Novosibirsk; Roza I. Shabalina, ulitsa Udaltsova, 4, kv. 26, Moscow; Mark M. Lakernik, Strastnoi bulvar, 13a, kv. 32, Moscow; Alexandr F. Gavrilenko, Yaroslavskaya ulitsa, 1/9, kv. 71, Moscow; Anatoly A. Yakovenko, bulvar Rainisa, 14, korpus 2, kv. 73, Moscow; Alla K. Elkina, Ljuberetsky raion, poselok Kosino, ulitsa Polevaya, 11, Moskovskaya oblast; Anatoly I. Golovachev, Otkrytoe shosse, 6, korpus 4, kv. 48, Moscow; Tatyana S. Egorova, ulitsa Mescheryakova, 2, kv. 9, Moscow; Jury M. Vlasov, ulitsa Dosova, 12, kv. 52, Istra Moskovskoi oblasti, all of U.S.S.R.; Matvei Y. Smelyansky, deceased, late of Moscow, U.S.S.R.; by Faina S. Zelichenko, administator, Uralskaya ulitsa, 6, korpus 5, kv. 107, Moscow, U.S.S.R.

[21] Appl. No.: 967,608

[22] Filed: Dec. 8, 1978

Related U.S. Application Data

[62] Division of Ser. No. 751,067, Dec. 16, 1976, Pat. No. 4,141,721.

[51] Int. Cl.[2] ..... H05B 7/18

[52] U.S. Cl. ..... 266/148; 266/227

[58] Field of Search ..... 266/148, 227; 75/11, 75/12, 14, 65 EB

[56] References Cited

U.S. PATENT DOCUMENTS

| | | | |
|---|---|---|---|
| 2,847,295 | 8/1958 | Bretschneider | 266/148 |
| 3,240,590 | 3/1966 | Schmidt | 266/148 |
| 3,764,297 | 10/1973 | Coad | 75/12 |
| 3,891,427 | 6/1975 | Persson | 75/12 |
| 3,985,545 | 10/1976 | Kinoshita | 75/12 |

*Primary Examiner*—P. D. Rosenberg

*Attorney, Agent, or Firm*—Lackenbach, Lilling & Siegel

[57] ABSTRACT

An apparatus for processing complex metallic materials, such as, copper-zinc or copper-lead-zinc concentrates and also slag-containing zinc and lead, by melting these materials in an atmosphere of gas containing free oxygen, and reducing the resulting melt by means of a gaseous plasma jet formed, for instance, by nitrogen. The apparatus includes one or several plasmatrons whose nozzles are immersed in the melt at an angle to its surface for agitation of said melt by the plasma jet and for reduction of the metal oxides.

4 Claims, 5 Drawing Figures

APPARATUS FOR THE COMPLEX CONTINUOUS PROCESSING OF POLYMETALLIC RAW MATERIALS

This is a division of application Ser. No. 751,067, filed Dec. 16, 1976, now U.S. Pat. No. 4,141,721.

The present invention relates to processes and systems used in non-ferrous metallurgy, and more specfically, to methods for complex processing of complex metallic materials, such as copper-zinc and copper-lead-zinc concentrates, slags containing zinc and lead, and also metallurgy products containing leads, zinc, antimony and other volatile components.

The invention also relates to an apparatus for carrying out the above method.

The method according to the present invention makes it possible to process complex metallic materials and obtain a high yield of metals.

Known in the art are various methods of processing copper and complex metallic concentrates. For example, there is known a method for processing ores and concentrates containing non-ferrous and rare metals (cf. U.S. Pat. No. 3,555,164; Brit. Pat. No. 1,186,088; Canad. Pat. No. 869,477; and Swed. Pat. No. 335,232).

According to the known methods, the material being processed and oxygen are fed into a cyclone chamber wherein oxidizing melting and partial sublimation of volatile metals take place and wherefrom the molten materials are directed into an electrothermic furnace, with some of the non-ferrous metals within the melt being processed therein.

This method does not provide for sublimation of zinc at a rate over 0.5 kg of zinc per 1 $m^3$ of melt per min, which makes it necessary to use a large-area electrothermic furnace. This results in higher heat losses, hence in higher specific power consumption.

The melting chamber and the furnace are separated with a cooled partition wall which prevents sulfur dioxide from getting into the electrothermic furnace.

The furnace is provided with a condenser for vapors of metals which are sublimated during the electrothermic treatment of slag.

Oxidic materials poor in sulfur are processed with the addition of liquid or solid fuel.

There are also known various methods of processing polymetallic materials and zinc slags by fuming for extraction the metals contained therein.

For instance, there are methods, for fuming slags with the use of liquid fuel (cf. Brit. Pat. No. 1,161,164 and Bulg. Pat. No. 24,366 No. 138/).

This method consists in fuming liquid fuel under a pressure of not lower than 15 atm, mixing it with air and injecting the resultant mixture into the slag being processed. The method is used for lead, tin, and copper slags. Also known is blasting of liquid slag with gaseous reducing compounds formed during the burning of a mixture of liquid fuel and air (cf. Canad. Pat. No. 832,278).

The rate of zinc sublimation therein amounts to 1–5 kg per $m^3$ of melt per minute.

This method does not provide for processing slags from old slag dumps. The process features emission of a large volume of gases which, to be fully utilized, will require construction of boiler plants and filtering bags. Besides, this method is intermittent rather than continuous.

In addition, a method is for the electrothermic processing of slags (cf. USSR Inventor's Certificate No. 145,755).

Here, initial slag dumps are melted at a temperature ranging from 1,350° to 1,400° C., with 3–5% of reducing agent, 10–15% of pyritic concentrate and 10% of limestone being added therein. In the process of melting, copper and noble metals go into a low-copper matte, while zinc, cadmium and rare metals sublimate.

This method allows a zinc sublimation rate of not over 1 kg per 1 $m^3$ per min.

It is therefore, an object of the present invention to provide a method for complex continuous processing of complex metallic materials which allows sulfidic and oxidic materials to be melted in a most efficient way.

According to the present invention, sulfidic copper-zinc concentrates can be subjected to autogenous melting by burning part of the sulfur from the sulfides in a flame or a cyclone in an atmosphere of oxygen or air enriched by oxygen, which results in obtaining a gas rich in sulfur dioxide, a matte rich in copper, and a slag which contains zinc.

The gas chamber and the metal bath of a furnace are separated by a partition wall, the zinc slag obtained being blasted with a low-temperature plasma jet, which makes it possible to effect reduction at a high speed comparable with the speed of the flame melting the initial material and to condense the zinc vapors obtained in the form of liquid metal or oxidized sublimation products.

In processing oxidic materials, e.g., zinc slags, the melting thereof can be effected in a melting chamber provided with electrodes like an ore melting furnace, in a neutral or slightly oxidizing medium which prevents the reduction or sublimation of zinc. Here, the input electrical energy is used entirely for melting slag, which makes for higher specific output of the melting chamber and lower specific power consumption. The melting chamber need not be separated from other parts of the furnace installation, which simplifies the equipment and maintenance thereof. The zinc present in the melt is sublimated in the second chamber of the installation under the action of a plasma jet in a reducing atmosphere similar to that used in melting sulfidic materials.

Another object of the present invention is to bring a reducing plasma jet in close contact with the melt containing oxides, whereby reduction of the component metals is speeded up. Since the reduction is additionally retarded by the diffusive character of the process, the agitation of the melt produced by the plasma jet eliminates the diffusive retardation and sharply increases the rate of reduction.

Another object of the present invention is to speed up drastically the reduction of zinc oxide and to remove the metal vapors being formed from the melt through conversion of natural gas with a plasma jet in combination with air or oxygen, said conversion being accompanied by the formation of carbon and hydrogen oxides which are especially active thereupon.

Another object of the present invention is to use a nitrogenous plasma jet for agitating the slag bath, for eliminating diffusive resistance therein, and also for accelerating the sublimation of zinc.

Another object of the present invention is to use a layer of coke on the surface of said bath as an active deoxidizer for the slag that is ejected by the plasma jet into the gas chamber and is spread over the coke's surface. The low consumption of coke (strictly stoichiometric according to the reaction $ZnO+C \rightarrow Zn+Co$) and a simple charging thereof on the bath surface make its use in the process very efficient.

Another object of the present invention is to carry out processing in an apparatus of minimum size and, accordingly, with minimum thermal losses, making it possible to achieve the required result, that is, to melt the material, to obtain gases rich in sulfur dioxide, to sublimate zinc and to condense the vapors in the form of liquid metal or oxidized sublimations.

Autogenous melting of sulfides enables adequate overall heating of the melt, which reduces power consumption. The heated melt does not cool down during flow-overs, while such cooling is inevitable where separate installations are in use.

The resulting zinc vapors travel the shortest way to arrive at the condenser, which makes for better condensation and reduces the amount of return products.

A sublimation chamber of the apparatus incorporates a device used to form a low-temperature plasma, with a nozzle thereof being immersed in the melt, which ensures injection of the plasma jet directly into the zone of reaction. In addition, the plasma jet provides for the required agitation of the melt, which, in turn, speeds up reducing reactions and intensifies the process as a whole.

Another object of the present invention is to determine the optimum position of the device for forming a low-temperature plasma as regards efficient agitation therewith and longer service life of the chamber walls.

Depending on the viscosity of slag that is related to its composition and temperature, the device should be positioned at different points of the bath. The position referred to hereinafter meets this requirement.

Another object of the present invention is to provide an apparatus wherein the nozzle can be displaced vertically and submerged in the melt to various depths for the purpose of changing the extent of agitation depending on the gas pressure, the melt viscosity, and the required extent of spraying the melt over the coke.

To accomplish these and other objects according to the present invention, there is provided a method for the complex continuous processing of complex metallic materials, specifically, of copper-zinc composition, including two-stage successive processing, wherein the initial material is melted at the first stage, and the reducing melting thereof is carried out at the second stage; said method is characterized by the use of a gas containing free oxygen as the atmosphere wherein the initial material is melted, whereas the reducing treatment of the melt thus obtained is effected by means of a plasma flame with a temperature ranging from 4,000° to 5,000° C., while the temperature of the melt surface is maintained within the range of 1,500° to 1,600° C.

This arrangement provides for most expedient processing of sulfidic and oxidic raw materials.

First, in processing sulfidic copper-zinc concentrates, these can be subjected to autogenous melting by burning a part of sulfur out of the sulfides in a flame or a cyclone in an atmosphere of oxygen or air enriched with oxygen, which results in obtaining a gas rich in sulfur dioxide, a matte rich in copper, and a slag which contains zinc. The gas chamber of a furnace installation and the metal bath thereof are separated by a partition wall, the zinc slag obtained is blasted with a low-temperature plasma jet, which makes it possible to carry out the process of reduction at a high speed commensurate with the speed of melting the initial material and to condense the evolved zinc vapors in the form of liquid metal or oxidized sublimates for further hydrometallurgical processing.

Second, in processing oxidic materials, e.g., zinc slags, the melting thereof can be effected in the melting chamber, provided with electrodes of the ore melting furnace type, in a neutral or slightly oxidizing atmosphere, which precludes reduction or sublimation of zinc. The input electric energy is used entirely for melting the slag, which makes for higher specific output and lower specific power consumption. The melting chamber need not be separated from other parts of the apparatus, which simplifies the construction and maintenance of the latter.

The zinc present in the melt is sublimated in the second chamber of the installation under the action of a plasma jet in a reducing atmosphere, like in melting sulfidic raw materials.

According to an embodiment of the present invention, the method is characterized by blasting the melt with a plasma jet during the reducing melting and by agitating the melt to reduce the metal oxides present therein.

This makes it possible to bring the reducing gas flow into close contact with the melt containing oxides, whereby the metal reduction is speeded up. Since the reduction is additionally retarded by the diffusive character of the process, the agitation of the melt eliminates the diffusive retardation and sharply accelerates the reduction.

According to another embodiment of the present invention, the method is characterized by the use of natural gas as a plasma-forming agent.

That feature makes it possible, through the use of a natural conversion of natural gas in a plasma jet in combination with air or oxygen, to utilize carbon and hydrogen oxides, which are especially active when formed, for reducing the metal oxides and to speed up drastically the reduction of zinc oxide and the removal of the metal vapors being formed from the melt.

According to still another embodiment of the present invention, the method is characterized by the use of nitrogen as a plasma-forming gas.

That makes it possible to use the nitrogen produced as a by-product at oxygen plants for bubbling the metal bath, for eliminating diffusive resistances therein, and for sharply accelerating the sublimation of zinc.

According to a further embodiment of the present invention, the method is characterized by the use of a layer of coke which is formed on the surface of the melt in the process of reduction.

This makes it possible to use a thin layer of coke on the surface of the bath as an active reducer for the streams of slag ejected into the gas chamber by the bubbling gas and spread over the coke's surface. A low consumption of coke (strictly stoichiometric according to the reaction $ZnO++CO \rightarrow Zn+CO_2$) and a single charging thereof on the bath surface makes its use in the process very efficient.

According to another embodiment of the present invention, there is provided an apparatus for carrying out the proposed method, which comprises a melting chamber for melting the materials and metal oxides thereof, and a reducing-sublimating chamber connected with the melting chamber which, in turn, is connected through a gas duct with a chamber for condensing metal vapors. This apparatus is characterized by the provision of at least one plasmatron built into the lining of said reducing-sublimating chamber with a nozzle being permanently immersed in the melt for injecting a plasma jet thereinto.

This makes it possible, with an apparatus of the minimum size and, correspondingly, with minimum thermal losses, to attain the required aim, that is to melt the material, to obtain gases rich in sulfur dioxide, to sublimate zinc from the melt, and to condense the vapors in the form of a liquid metal or powdery sublimates.

Autogenous melting of sulfides allows adequate overall heating of the melt, which reduces power consumption by said plasmatron. The heated melt does not cool down during flow-overs, although that is inevitable where separate installations are in use. The zinc vapors obtained travel the shortest way to the condenser, which makes for better condensation and reduces the amount of return products.

The plasmatron incorporated in the sublimating chamber with its nozzle immersed in the melt ensures the injection of the plasma jet directly into the reaction zone. In addition, the plasma jet ensures the necessary agitation of the melt, which, in turn, makes for faster reducing reaction and intensified process as a whole.

According to still another embodiment of the present invention, there is provided an apparatus characterized by the use of one or several plasmatrons arranged in parallel which can be positionally adjusted with respect to the chamber walls and which are set up at an acute angle to the melt surface.

That arrangement provides for the most advantageous position of the plasmatrons to be selected as regards the efficiency of melt agitation and longer service life of the chamber walls.

Depending on the viscosity of slag, related to its composition and temperature, the plasmatron should be positioned at various different points of the bath.

The plasmatron position referred to herein meets that requirement.

In addition, there is provided an apparatus according to the present invention, characterized by a mechanism introduced for moving the plasmatron nozzle within the melt, agitating the melt as this undergoes reduction, and the sublimating chamber being provided with means for charging coke on the melt surface.

This makes it possible to displace the plasmatron nozzle vertically, immerse it in the melt to different depths changing the extent of bubbling depending on the gas pressure, the melt viscosity, and the required extent of spraying the melt over the coke.

Embodiments of the present invention will now be described in greater detail by way of example with reference to the accompanying drawings, wherein.

The method for continuous processing of complex metallic sulfidic materials according to the present invention consists in that a complex metallic sulfidic concentrate is melted in a cyclone or a stack in an oxygen flow.

The sulfur-rich gases are separated from dust and then used in the production of sulphuric acid or elementary sulfur.

The melt is separated in the melting chamber, according to specific weights, into slag, matte, and metal.

The metal and matte are tapped from the melting chamber, whereas the slag enters the second sublimating chamber, where it is agitated and its volatile components are reduced and sublimated under the action of a reducing plasma jet.

The sublimated vapors of the volatile metals arrive at the condenser where these are turned into a liquid metal or are burned to obtain oxidized sublimates.

The plasma may be formed by natural gas or nitrogen. In the latter case, the sublimating chamber is charged with coke.

In processing oxidic complex metallic raw materials or metallurgical sub-products, these are melted in the electrothermic part of the apparatus, and the molten slag is then processed similarly to complex metallic materials.

The method of processing complex metallic materials according to the present invention makes it possible to melt sulfidic materials and sulfurless ores, concentrates, and metallurgical sub-products.

Sulfidic materials e.g., copper-zinc concentrates, can be melted in an autogenous mode or with the addition of fuels in a vertical flame in a cyclone furnace. Oxidic materials, e.g., zinc-bearing slags, are melted in the electrothermic part of an apparatus.

The melt obtained as described hereinbefore enters the reducing chamber separated by a partition wall from the melting chamber, where it is subjected either to the reducing action of a plasma jet or to the action of a nitrogen plasma for agitating the melt where it bears the layer of coke.

Figure 1:
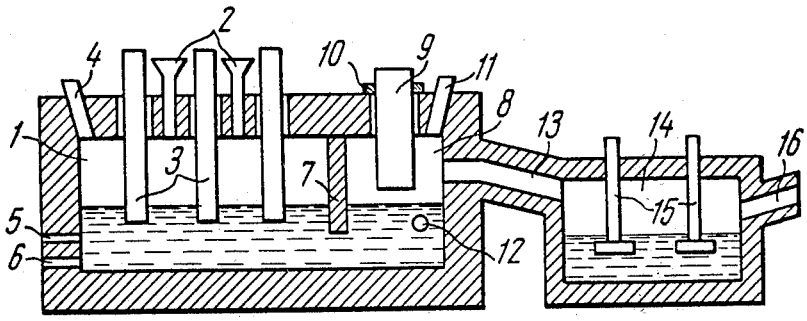
FIG. 1 illustrates an installation for the complex continuous processing of complex metallic materials with a partition wall separating the gas space.

According to FIG. 1, the apparatus includes a melting chamber 1, provided with devices 2 for charging solid materials, and with devices for melting the material being processed, e.g., electrodes 3; a gas duct 4 for removing gases from the melting zone; openings 5 and 6 for tapping off matte and metal, respectively; and a partition wall 7, separating the chamber 1 from a chamber 8, which is used to remove metals from slag. The chamber 8 is provided with devices 9 to form a low-temperature plasma (plasmatrons), with seals 10, devices 11 for charging coke, a hole 12 for tapping slag, and a gas duct 13, connecting the chamber 8 and a chamber 14 for condensing the metals removed from the slag. The chamber 14 is provided with spraying devices 15 and a gas duct 16.

Figure 2:
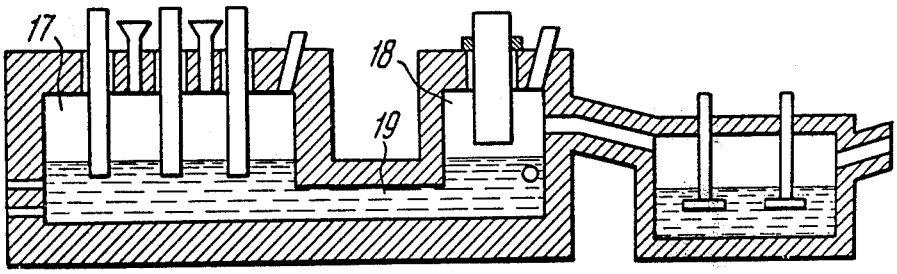
FIG. 2 shows an apparatus for complex continuous processing of complex metallic materials with a channel connecting two melt zones.

In another embodiment of the apparatus according to FIG. 2, a chamber 17 is connected with a chamber 18 through a channel 19.

Figure 3:
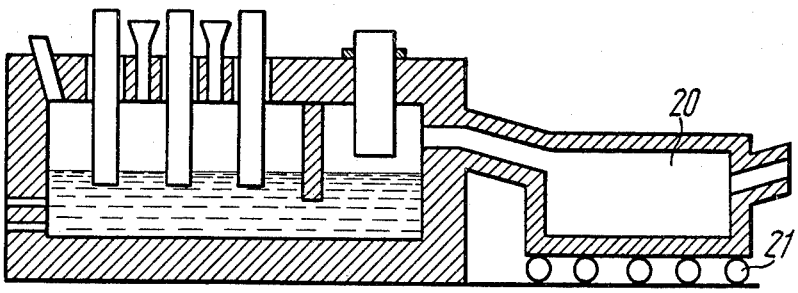
FIG. 3 shows an apparatus for complex continuous processing of complex metallic materials with a chamber for final burning of zinc vapors.

In the case where zinc is to be obtained in the form of oxide, the apparatus is provided with a chamber 20 (as shown in FIG. 3) for oxidizing the metal vapors removed from the slag. The chamber 20 can be mounted on rolls to compensate for its temperature expansion, as shown in FIG. 3.

In processing sulfidic materials or other materials containing fuels suitable for autogenous burning or burning with the addition of fuels, the apparatus can have, as the device for melting the materials being processed, a cyclone 22 (FIG. 4) with an ejector 23 for supplying a charge thereby, or a stack 24 (FIG. 5) with burners 25 used to burn and melt the charge.

The apparatus operates as follows.

According to FIGS. 1, 2, and 3, an oxidic material which contain no fuels, e.g., a slag containing zinc or other volatile metals, is charged through respective devices. The material gets into the chamber 1, where it is melted with the aid of the electrodes, immersed in the slag, and then enters the chamber 8 where zinc is reduced and sublimated in the form of vapors under the action of reducing gases produced by the devices forming a low-temperature plasma. The vapors enter the condenser 14, where they are cooled, turn to a liquid, wherefrom zinc is tapped off as it accumulates.

Where a nitrogenous plasma is used, the chamber 8 (FIG. 1) is charged with coke which is delivered to the melt surface through the charging devices 11.

Where volatile metals are obtained in the form of oxides, the vapors of zinc enter the chamber 20 for vapors oxidation (FIG. 3).

The melted slag, poor in non-ferrous metals after their extraction therefrom, is continuously or periodically tapped from the chamber 8 through the hole 12. Where metal or matte are obtained, they are periodically tapped off, on accumulation, through the holes 6 and 5 of the chamber 1 (FIG. 1).

As it is possible to run the process in an evacuated as well as non-reducing atmosphere within the chamber 1, the latter does not require sealing and the electrodes 3 may be left untightened in its roof in this mode of operation. In this case, use can be made of electrodes that will spontaneously weld with the metal furnace shell, which makes it possible for the melting chamber to consume virtually any specified power and thereby ensure the high output of melting.

The division of the installation into two zones, the melting and the sublimating ones, makes it possible to have in the first, larger, zone a melt temperature not higher than the fusing temperature for the material being processed, to work with a layer of solid charge on the molten bath, and hence to reduce considerably the melt-chamber's heat losses through the walls, the hearth and the roof of the furnace. This results in lower specific power consumption.

The devices 9 for the formation of a low-temperature plasma allow for adjustment of the power consumption, and of the flow rate, pressure, and temperature of reducing or neutral gases.

Said devices 9 for the formation of a low-temperature plasma can be mounted into the walls of the chamber 8 as well as into its roof at right or acute angles to the melt surface; moreover, they can be shifted at an angle to each other in both vertical and horizontal planes. The nozzles of the devices 9 can be immersed in the melt to different depth.

The devices 9 can be provided with suitable actuating mechanisms.

In order to prevent the lining of the walls in the chambers 1 and 8 from wear, the partition wall and the connecting gas duct can be coffered and cooled by water or other heat-transfer agents.

Figure 4:
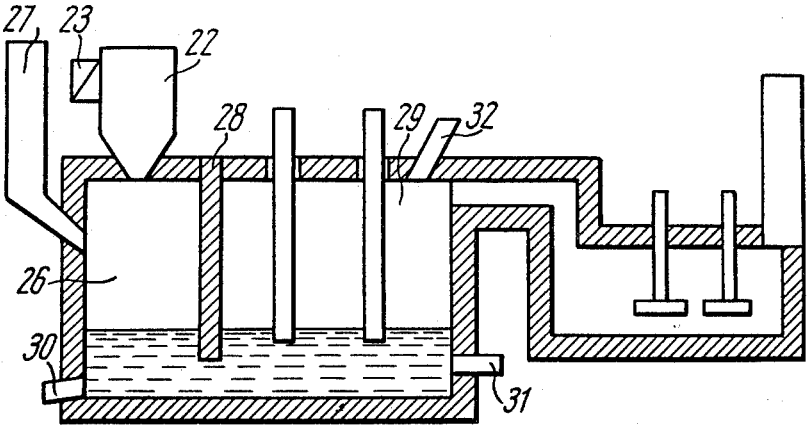
FIG. 4 shows an apparatus for complex continuous processing of complex metallic materials with a melting cyclone.

The apparatus for processing sulfidic concentrates according to FIG. 4 operates as follows.

A dried sulfidic concentrate or other fuels containing the necessary materials, are blown in along with fluxes through the ejector 23 of the cyclone 22 by means of a jet of oxygen or air enriched by oxygen.

The charge is melted by the heat generated either by the exothermal reactions of sulfide oxidation or by the burning of the fuel introduced into the cyclone. The molten charge then flows down the cyclone walls into the melting chamber 26.

The produced gases are removed through the gas duct 27 for further processing.

The melt entering the chamber 26 stratifies according to the specific weights of the components thereof. In the processing of materials containing, for instance, zinc, lead and copper, the metallic lead evolved settles on the chamber's hearth, the copper matte forms a layer directly above the lead, and the zinc-bearing slag forms the uppermost layer.

The melt depth is maintained such that the partition wall 28 is permanently immersed in the layer of the slag. This arrangement prevents the gases in the chambers 26 and 29 from mixing, but allows a free exchange of the melt between these chambers.

As the lead and the matte accumulate, they are periodically tapped from the furnace through the openings 30 and 31.

The slag is tapped off through the opening 32 either continuously or intermittently. Reduction takes place in the chamber 29.

Figure 5:
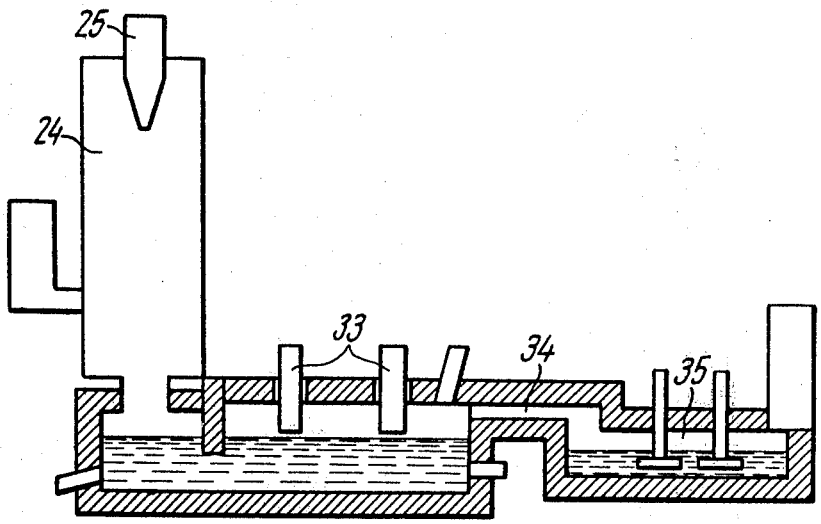
FIG. 5 shows an apparatus for complex continuous processing of complex metallic materials with a melting stack, according to an embodiment of the invention.

The apparatus according to FIG. 5 operates as follows. The charge is oxidized and melted by means of the vertical burner 25, mounted in the stack 24; the volatile metals are sublimated through interaction of the slag melt with a reducing low-temperature plasma produced by the devices 33 adapted for the formation thereof, or through the interaction of the slag melt, agitated with a nitrogenous low-temperature plasma, with the coke.

The reduced vapors are removed through the gas duct 34 either to the condenser 35, where the metal vapors are condensed into liquid metals, or to the chamber 20 (FIG. 3) used for afterburning, where the metal vapors are oxidized.

The following examples illustrate the invention.

EXAMPLE 1

For processing of mixed metallic concentrates, a copper-zinc concentrate containing sulfur (S), 7–25% of copper, and 7–25% of zinc is dried to a moisture content of 0%, and is supplied to a bin placed beside the furnace at a rate of one ton per hour. Therefrom, the concentrate with the addition of crushed quartz is blown tangentially with a stream of oxygen at a rate of 200 $m^3$ per ton of charge, by means of a burner tangentially into the cyclone chamber or into a burner built into the stack. The gases that contain 75% of sulfur dioxide ($SO_2$) are used for making sulfuric acid, and the melt of matte and slag stratify according to the specific weights of components. The matte settles on the bottom and is tapped of as it accumulates in excess of a 200 mm level. The slag forms the upper layer of the molten bath and enters the reducing-sublimating chamber. Here, the slag is blasted with a plasma jet and, on accumulation, is intermittently tapped off through a hole located at 500 mm above the hearth. The overall level of the melt in the furnace is 700–750 mm.

The vapors of zinc pass to the condenser, whose free volume is sprinkled with metal drops by an impeller from a zinc bath located at the bottom of the condenser. A constant temperature of 500° C. is maintained in the condenser, which makes for faster cooling of the vapors and prevents their oxidation by steam and carbon oxide.

The zinc sublimate can be oxidized in the chamber by the air fed thereinto; the oxides thus obtained can be collected in the filtering bags after cooling the gases.

EXAMPLE 2

For processing of zinc-bearing slags, granular slag from old slag dumps containing 1–1.5% of copper, up to 2.5% of lead, and 8–15% of zinc is dried in a tube furnace and charged into the melting chamber of an electric furnace installation (one ton per hour) heated through electrodes immersed in slag. The furnace does not require sealing; the atmosphere therein is neutral. The melt-bath level is up to 750 mm.

The melt enters the reducing-sublimating part of the installation where it is acted upon by a plasma jet. Using a nitrogenous plasma part of the installation is charged with crushed and dried coke. With natural gas being used, conversion, thereof is accompanied by the emission of black carbon and hydrogen, which serve to reduce zinc oxide.

The zinc vapors are removed into the condensor or the burning chamber, whereas the slag, as it accumulates, is tapped off through the corresponding hole.

Some other embodiments of the method are described below.

EXAMPLE 3 Melting of a Mixed Metallic Concentrate

A copper-zinc concentrate containing from 5 to 25% of copper and from 5 to 25% of zinc is mixed with quartz ore containing 75% of silica; the charge obtained is dried in a tube furnace to a moisture content of 1%. The dry charge is delivered through a pneumatic conveyor to a bin mounted over the furnace installation, wherefrom the charge is directed by a feeding device into a tube at a rate of one ton per hour. The tube receives a stream of oxygen, at a rate of 200 $m^3$ per ton of charge to blow said charge into a cyclone.

Here, the charge is melted, then flows down the cyclone walls into a melting chamber at 1,250°–1,300° C. The gases containing 75% of sulfurous anhydride are removed through a water-cooled standpipe and electric filters and are then used in admixture with other gases for making sulfuric acid.

In the melting chamber, the melt stratifies into a matte containing 50% of copper and a slag containing 10% of zinc, up to 1% of copper, 20–25% of iron, and 30–35% of silica.

The slag fills the space behind the partition wall that forms the reducing-sublimating part of the installation.

The plasmatrons immersed with their nozzles in the melt to a depth of down to 200 mm ensure the required agitation of the melt, the specific rate of gas being 1.3 $m^3$ per 1 $m^3$ per min. The zinc content of the melt drops from the initial value of 10% to 0.5–0.7%. The zinc is reduced at a rate of 10 kg per 1 $m^3$ per min. The reducing chamber is charged with coke in amounts of 1.5–2% of the slag weight.

The mixture of vapors and gases, is injected into the condenser, where the zinc vapors and condensed and the gases are burned.

The gases can be compressed and used for heating purposes. The heating power thereof mounts up to 3,000 large calories for 1 $m^3$.

With nitrogen used as the plasma-forming gas, the yield of zinc amounts to 80%; the remainder is condensed and, as a return product, goes back to the charge for melting.

As the vapors are burned, the gases are cooled down through suction or air whose volume is 10–15 times that of the gases.

The gases are separated from dust in a filtering bag. The dust obtained contains 65% of zinc and up to 12% of lead.

With the use of natural gas as the plasma-forming agent, it undergoes conversion in the plasmatron hence, no addition of coke to the melt is required since zinc is reduced with the adequate amounts of black carbon and hydrogen formed during such conversion.

The gas flow rate, the yield of fuels, and the processing of gases are similar to those described above, but the yield of metallic zinc is not over 75%, with the rest going into return products.

EXAMPLE 4 Melting of Zinc-Bearing Slags

A lead-melting slag, containing up to 1.5% of copper, 15% of zinc, up to 2% of lead, 23–25% of iron, 20–25% of silica, and up to 20% of calcium oxide is dried to a moisture content of 0.5% then charged into the melting chamber of a 1,000 cVA electric furnace at a rate of one ton per hour.

The furnace is provided with three electrodes. The melt obtained fills the space behind the partition wall and is subjected to the action of a plasma with characteristics similar to those described above. The matter containing 20–25% of copper is separated in the melting chamber of the furnace. The gases are separated from dust and are vented to the atmosphere.

The final slag contains 0.5–1% of zinc, 0.1% of lead, and 0.3% of copper.

Condensation runs similarly to that taking place in the melting of concentrates.

What is claimed is:

1. An apparatus for continuously processing complex, non-ferrous metallic compositions comprising a melting chamber for the melting of said compositions and accumulation of the corresponding metal oxides, said melting chamber being provided with means for charging non-ferrous metallic material which is heated to form a melt, and means for removing selected layers of the melt as they stratify according to their specific weights; a reducing-sublimating chamber communicating with said melting chamber to reduce and sublime the non-ferrous materials, said reducing-sublimating chamber also communicating with a gas duct and a chamber for condensation of the sublimated metal vapors, the lining of said reducing-sublimating chamber having at least one plasmatron built therein, said plasmatron having a nozzle permanently immersed in the melt adapted to inject thereinto a plasma jet capable of agitating and simultaneously reducing said melt, said reducing-sublimating chamber provided with means for charging coke on the surface of the melt also including an outlet for removing a melted slag, poor in non-ferrous metals.

2. An apparatus as claimed in claim 1, wherein one or several plasmatrons, arranged in parallel, are set at an acute angle to the melt surface, said plasmatrons being adjustable relative to the walls of a respective chamber.

3. An apparatus as claimed in claim 1, wherein there is provided a mechanism is provided for the displacement of said plasmatron within the layer of the melt.

4. The apparatus of claim 1, wherein the complex non-ferrous metallic compositions include materials selected from the group consisting of copper-zinc, copper-lead-zinc, lead-zinc, lead, zinc and antimony.

* * * * *